US006808457B1

(12) United States Patent
Paukert et al.

(10) Patent No.: US 6,808,457 B1
(45) Date of Patent: Oct. 26, 2004

(54) SITTING TOY WITH WATER JETS

(75) Inventors: William M. Paukert, Providence, RI (US); Douglas A. Schultheis, Cumberland, RI (US)

(73) Assignee: Hasbro, Inc., Pawtucket, RI (US)

( * ) Notice: Subject to any disclaimer, the term of this patent is extended or adjusted under 35 U.S.C. 154(b) by 0 days.

(21) Appl. No.: 10/424,512

(22) Filed: Apr. 28, 2003

(51) Int. Cl.[7] ..... A63G 1/12
(52) U.S. Cl. ..... 472/14; 472/128; 297/180.15
(58) Field of Search ..... 472/117, 128, 472/129, 137, 14; 297/180.15; 239/289

(56) References Cited

U.S. PATENT DOCUMENTS 2,579,150 A * 12/1951 Leopold et al. ..... 374/148
3,363,268 A * 1/1968 Friedlander ..... 4/506
4,119,310 A 10/1978 Trubody
4,245,837 A 1/1981 Menschel
4,526,366 A * 7/1985 Kenoun ..... 273/454
4,925,099 A 5/1990 Owen
4,982,959 A 1/1991 Rudell et al.
5,118,094 A 6/1992 Lambert
5,156,339 A * 10/1992 Gibson et al. ..... 239/289
5,795,235 A 8/1998 Ullrich et al.
5,823,617 A * 10/1998 Schafer ..... 297/180.15
5,862,990 A * 1/1999 White ..... 239/289

* cited by examiner

*Primary Examiner*—Kien Nguyen
(74) *Attorney, Agent, or Firm*—Marshall Gerstein & Borun LLP

(57) ABSTRACT

A sitting toy includes a base and a platform mounted to the base for rotation about a generally vertical axis. The platform includes an outer periphery and a central aperture. A handle is mounted to the base and extends upwardly through the aperture in the platform. A conduit is formed in the base, with the conduit including a plurality of nozzles spaced at intervals about the outer periphery of the platform, the conduit arranged for attachment to a water supply.

20 Claims, 6 Drawing Sheets

84
16
30
36
34
A
28b
47c
29
28a
28
47a
10
32
47
18
51
49
14
40
38
64
66
64
66
62
48
50
12
46
58
24
50
24
50
60
47b
20
26
27b
22
56
50
78
24

SITTING TOY WITH WATER JETS

BACKGROUND OF THE INVENTION

The present invention is directed to a spinnable sitting toy surrounded by a plurality of nozzles arranged to produce a plurality of water jets.

Spinnable sitting toys are known in the art and have been commercially marketed more than one year prior to the filing date of this patent. For example, a spinnable sitting toy marketed under the trademark SIT-N-SPIN® has a generally round platform supported for rotation on a base. The user, typically a child, sits on the platform, grasps a handle extending from the base upwardly through the platform, and causes the platform to rotate relative to both the handle and the base by applying a turning force to the handle.

U.S. Pat. No. 5,118,094 to Lambert discloses a sitting toy similar to the SIT-N-SPIN® sitting toy, but having a ratcheting handle. U.S. Pat. No. 4,925,099 to Owen discloses a stationary chair having framework provided with a plurality of sprinkler holes.

SUMMARY OF THE INVENTION

In one aspect, a sitting toy comprises a base, a platform rotatably mounted to the base and including an outer periphery, a handle engaging the base, and a conduit generally surrounding a major portion of the base. The conduit is arranged for attachment to a water supply, with the conduit including a plurality of nozzles disposed adjacent the outer periphery of the platform.

In further accordance with a preferred embodiment, the platform includes a central aperture, and the handle protrudes upwardly from the base through the central aperture. Preferably, the nozzles may be pointed in a generally upward direction generally surrounding the platform. The base may include a rim adapted to rotatably support the platform, and the conduit may be spaced radially outwardly from the rim. The platform preferably includes a downwardly extending skirt, and the base includes a channel defined radially inwardly from the conduit, with the channel sized to receive a lower portion of the skirt.

The platform may include an outer periphery and the base may include a channel defined radially inwardly from the conduit. The channel is sized to receive a portion of the outer periphery of the skirt. The conduit includes an inlet or other connector sized for connection to a garden hose or other suitable source of pressurized water.

In another aspect of the invention, a sitting toy comprises a base, a platform mounted to the base for rotation about a generally vertical axis, with the platform including an outer periphery and having a central aperture, a handle mounted to the base and extending upwardly through the aperture in the platform, and a conduit formed in the base. The conduit includes a plurality of nozzles spaced at intervals about the outer periphery of the platform, with the conduit arranged for attachment to a water supply.

In a further aspect of the invention, a sitting toy comprises a base, a round platform mounted to the base for rotation about a generally vertical axis, the platform including a central aperture, a handle mounted to the base and extending upwardly through the aperture in the platform, and a conduit formed in the base and including a plurality of nozzles. The conduit is arranged for attachment to a water supply, and the nozzles are spaced around the base to generally surround the handle and the central axis.

DETAILED DESCRIPTION OF VARIOUS EMBODIMENTS

Figure 1:
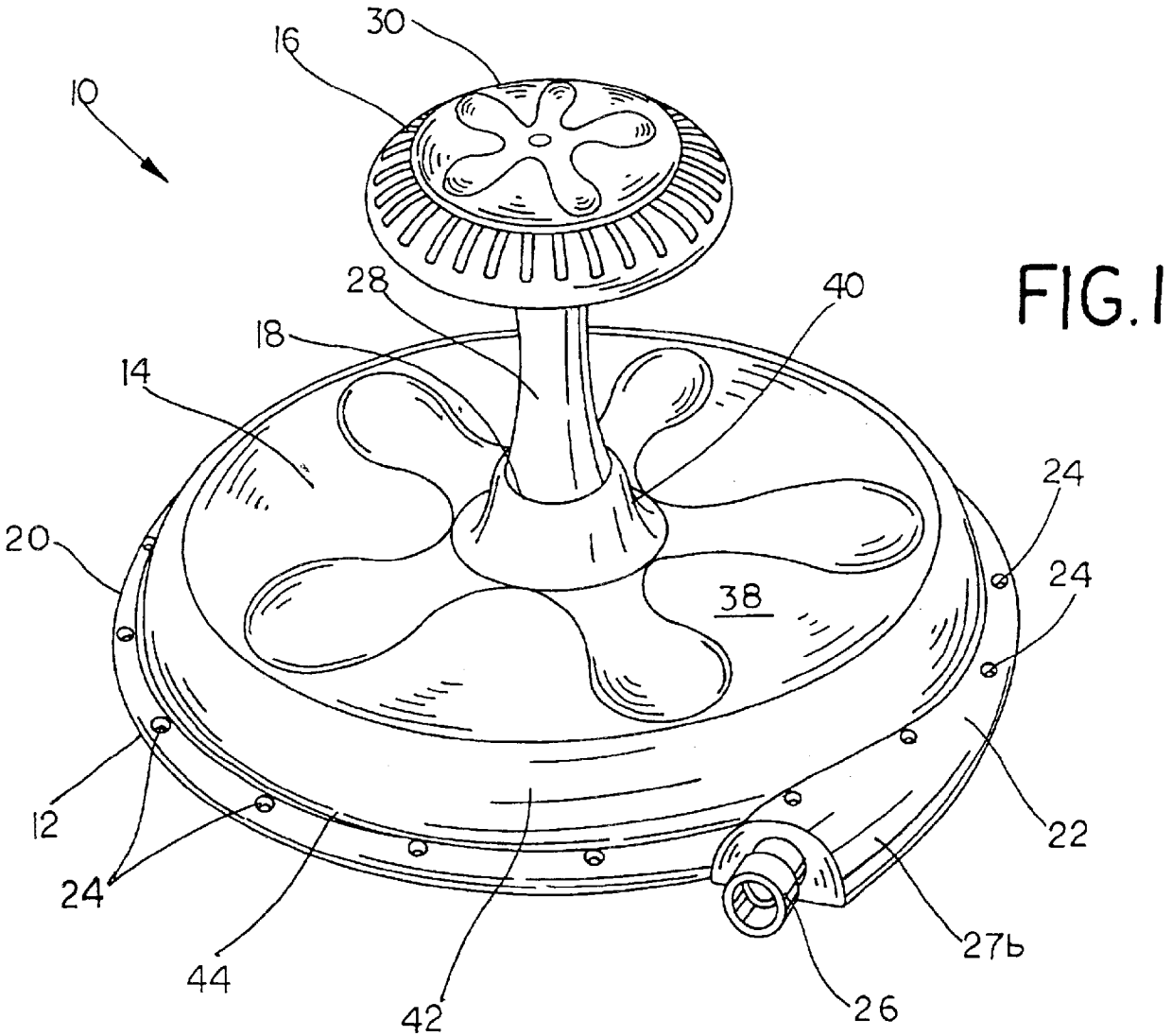
FIG. 1 is a perspective view from above of an embodiment of a sitting toy in accordance with the invention.

Referring now to the drawings, a sitting toy assembled in accordance with the teachings of the present invention is shown and is generally referred to by the reference numeral 10. The sitting toy 10 includes a base 12 and a platform 14, with the platform 14 being rotatably mounted to the base 12 in a manner that will be described in greater detail below. Preferably, both the base 12 and the platform 14 are generally round when viewed in plan. The sitting toy 10 also includes a handle 16, with the handle 16 preferably being non-rotationally mounted to the base 12 and extending through a centrally located aperture 18 in the platform 14.

Figure 2:
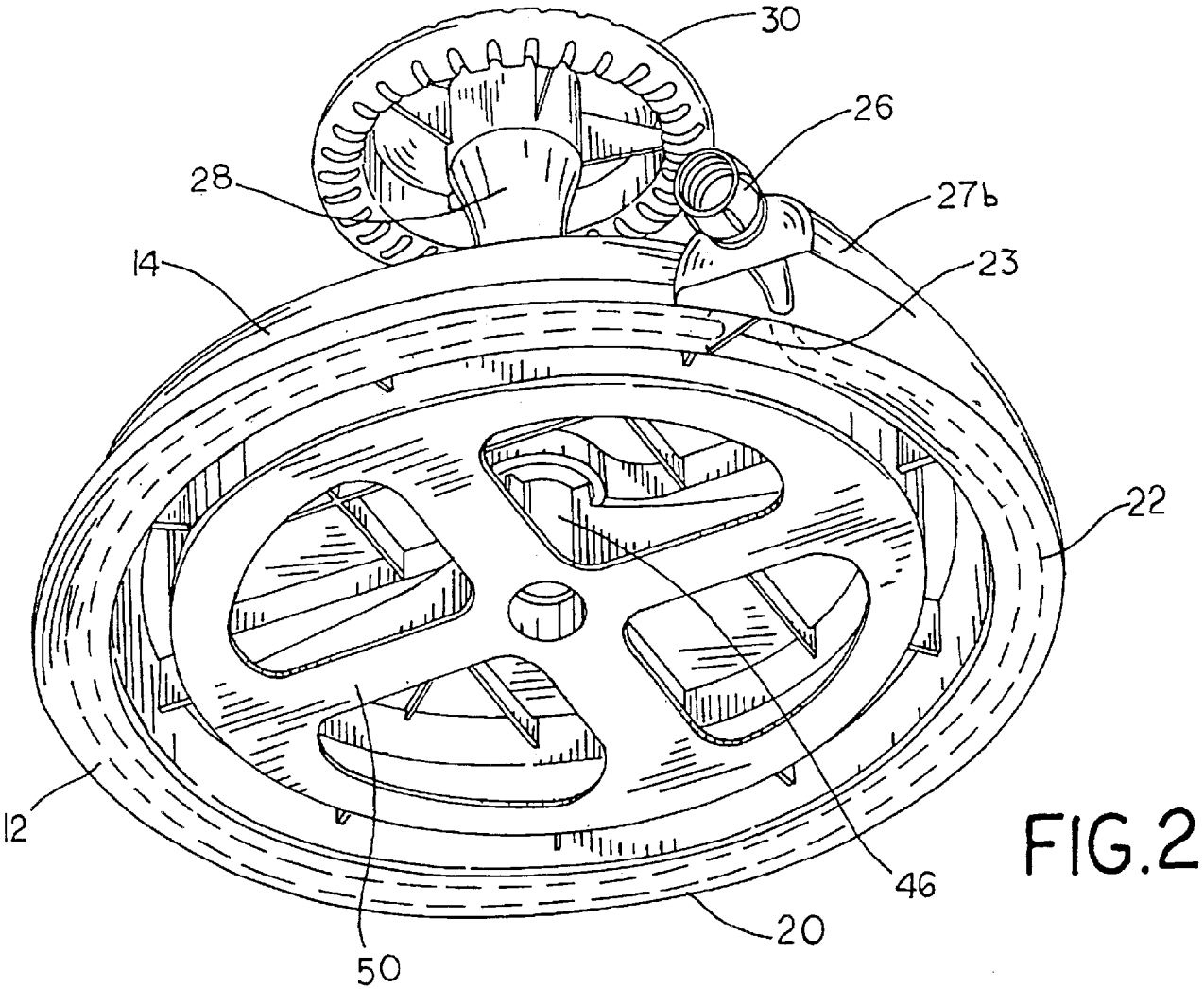
FIG. 2 is a perspective view from below of the sitting toy illustrated in FIG. 1.

The base 12 includes an outer periphery 20, which in the disclosed example is formed so as to define a conduit 22. Preferably, the conduit 22 will extend substantially about the outer periphery 20 of the base 12 as shown in phantom in FIG. 2. Further, the conduit 22 may be formed essentially as a ring extending completely around the base, or the conduit 22 may include an end wall 23 (FIG. 2), which defines an end of the conduit 22. As a further alternative, the conduit 22 may be formed in a plurality of sections, with each section being in flow communication with a centralized section or manifold (not shown) and fed by, for example, a number of radially outwardly extending conduits (not shown).

Figure 3:
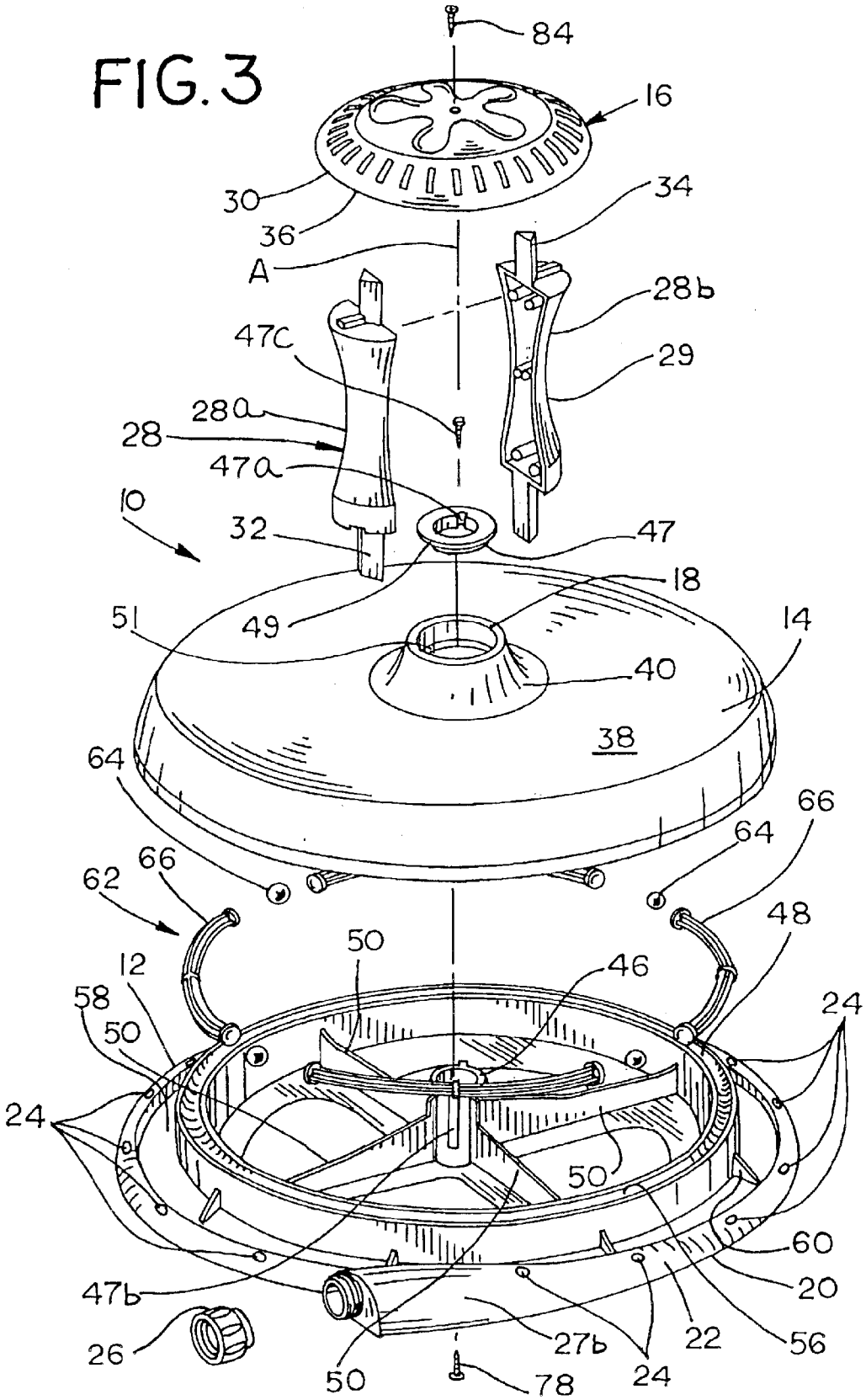
FIG. 3 an exploded view in perspective of the sitting toy illustrated in FIGS. 1 and 2.
Figure 4:
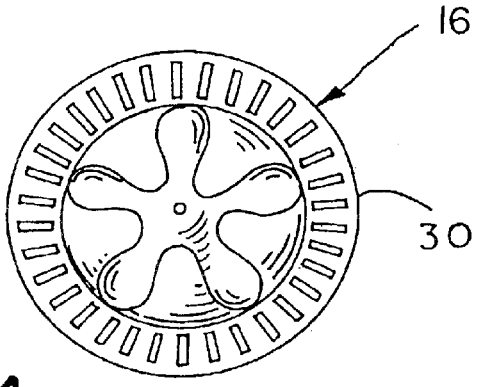
FIG. 4 is a side elevational view of the sitting toy.
Figure 6:
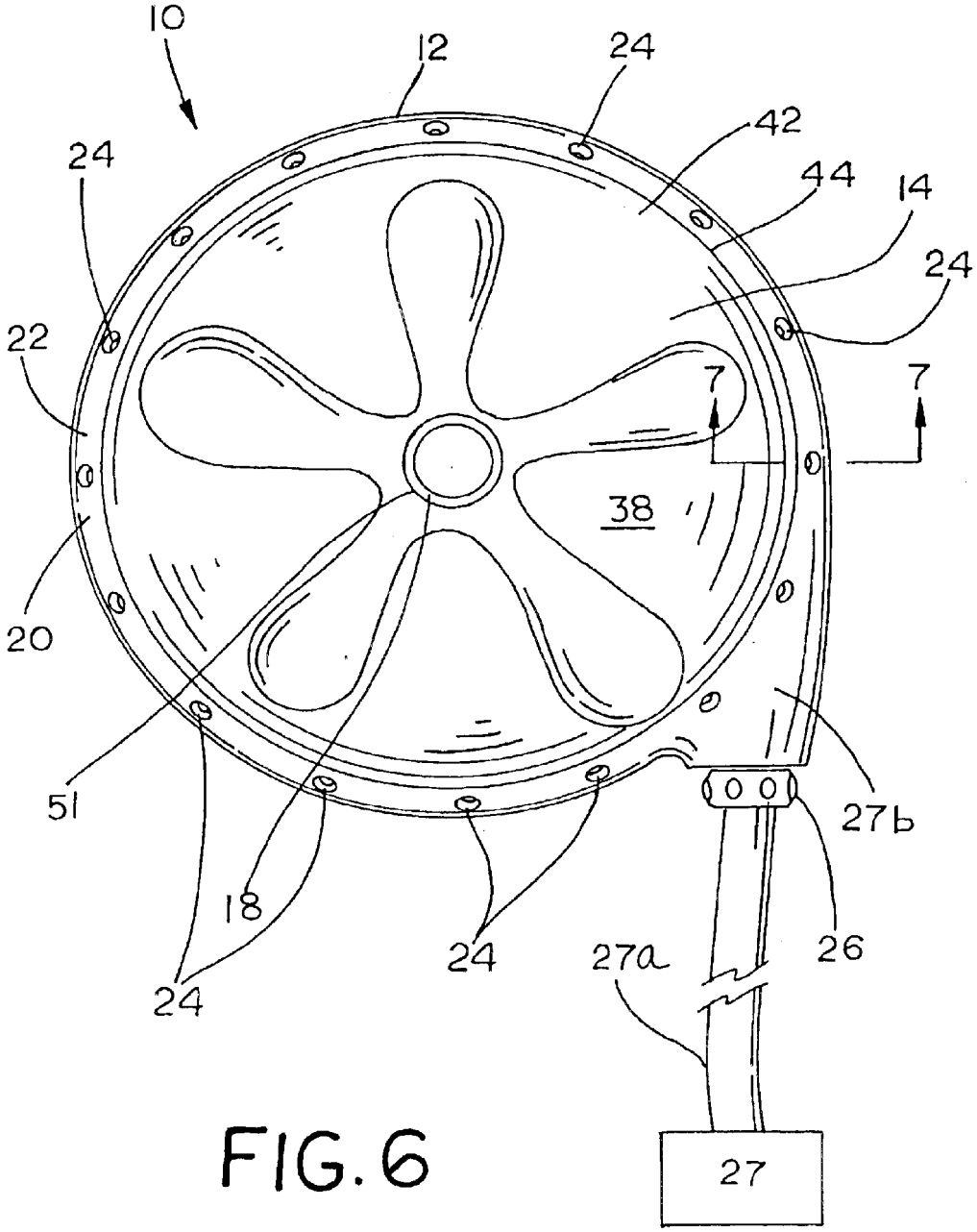
FIG. 6 is a fragmentary top plan view of the platform and the base taken along line 6—6 of FIG. 4.

As shown in FIGS. 1, 3 and 6, the conduit 22 includes a plurality of apertures or nozzles 24, with the nozzles 24 being spaced generally circumferentially about the outer periphery 20 of the base 12. The nozzles 24 are in flow communication with the conduit 22 and generally provide an outlet from the interior of the conduit 22 to the surrounding atmosphere. The conduit 22 preferably also includes a connector 26 which, in accordance with the disclosed example, takes the form of a conventional hose connector or hose bib of the type commonly found on residential garden hoses, thereby permitting the conduit 22 to be connected to a source 27 (FIG. 6) of pressurized water via a hose 27*a*. The connector 26 preferably is mounted to a widened portion 27*b* of the base 12, with the widened portion 27*b* sized so that the conduit 22 extends slightly outward from the generally round shape of the base 12.

The handle 16 includes a post 28 and a hand grip 30. In the disclosed example, the hand grip 30 is generally round. Preferably, the hand grip 30 may be shaped and textured so as to provide a comfortable gripping surface for the user. It will be noted that the post 28 is sized such that the hand grip 30 is spaced above the platform 14 so as to provide a space between the hand grip 30 and the platform 14 big enough to receive the legs of a user (not shown, but typically a child) seated on the platform 14, with the legs of the user generally straddling the post 28.

As shown in FIG. 3, the post 28 of the handle 16 may be formed from a pair of substantially identical halves 28*a*, 28*b*. The post 28 also includes a lower end 32 and an upper end 34. The lower end 32 is sized to extend through the aperture 18 in the platform 14, such that the lower end 32 may be connected to the base 12. The upper end 34 is connectable to an underside 36 of the hand grip 30. Accordingly, in the disclosed example, the handle 16, including the hand grip 30 and the post 28 are non-rotationally mounted to the base 12.

Figure 5:
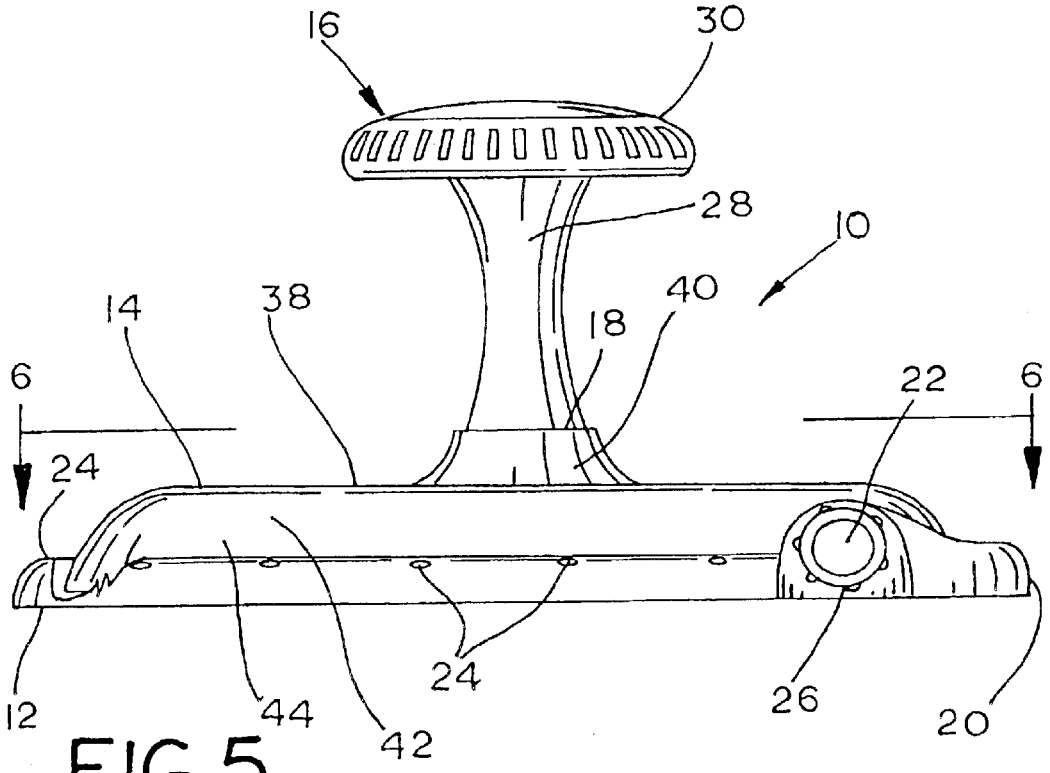
FIG. 5 is a top plan view of the handle.

The platform 14 includes a sitting area 38 which generally surrounds the aperture 18. An upper surface of the platform may be textured in a desired fashion as shown in FIGS. 1 and 6. The platform 14 may also include an upwardly extending cone 40 (FIGS. 1, 3 and 5) in the region generally surrounding the aperture 18. The platform 14 also includes an outer periphery 42 which, in accordance with the disclosed example, generally is shaped to form a downwardly depending skirt 44.

Referring now to FIG. 3, the base 12 includes a center section 46 which is generally aligned with the aperture 18 in the platform 14, and which center section 46 is sized to non-rotationally receive the lower end 32 of the post 28. The platform 14 may be secured to the base 12 using a slotted retaining ring 47 having a flange 49 sized engage an inwardly extending ring 51 defined in the aperture 18. The ring 47 preferably includes a slot 47*a* which engages a key 47*b* defined on the center section 46, and the ring 47 may be secured by a suitable fastener 47*c*.

Figure 7:
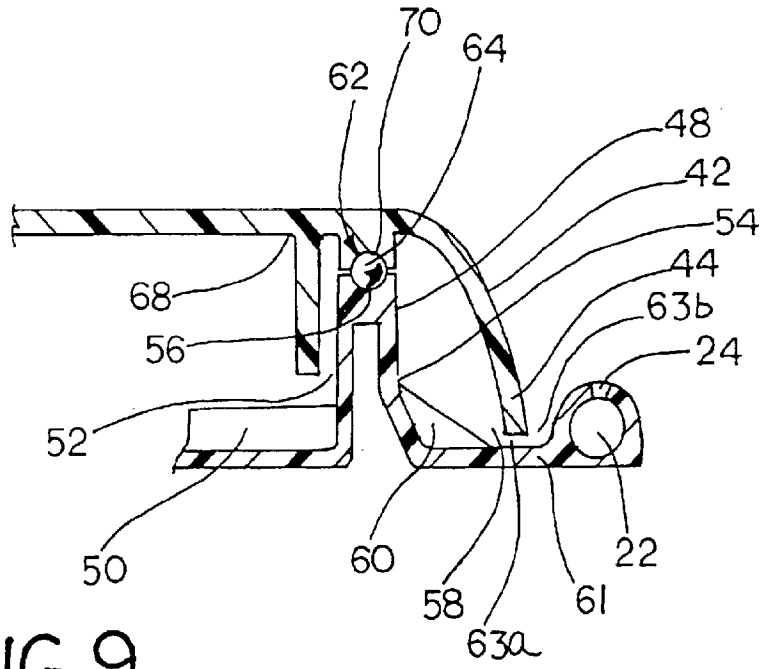
FIG. 7 is an enlarged fragmentary cross-sectional view taken along line 7—7 of FIG. 6.

As shown in FIGS. 3 and 7, the base 12 also includes a raised ring 48 which generally surrounds the center section 46 and, in the disclosed example, is connected to the center section 46 by a plurality of radially extending ribs 50. The raised ring 48 includes an inner sidewall 52, an outer sidewall 54, and a depressed groove 56. The conduit 22 is spaced radially outwardly from the raised ring 48, so as to define a channel or space 58 between the raised ring 48 and the conduit 22. The outer periphery 20 and the conduit 22 may be suitably stiffened relative to the balance of the base 12 by a plurality of ribs 60 extending generally between the outer sidewall 54 of the raised ring 48 and a section 61 that extends outwardly to the conduit 22. A small gap 63*a* is defined between the lower extent of the skirt 44 and the section 61, and a small gap 63*b* between the lower extent of the skirt 44 and the conduit 22. Preferably, these gaps may be in the neighborhood of about 3⁄16 of an inch.

Referring still to FIGS. 3 and 7, the platform 14 is rotationally supported on the raised ring 48 of the base 12 by a bearing assembly 62. The bearing assembly 62 preferably includes a plurality of ball bearings 64 which are sized to be received in the groove 56 of the raised ring 48. The bearing assembly 62 also includes a plurality of spacers 66 (FIG. 3) which are also sized to be received in the groove 56 of the raised ring 48. The spacers 66 are curved to match the curvature of the groove 56 and, in the disclosed example, act to keep the ball bearings 64 suitably spaced apart so as to provide adequate support for the platform 14, such that the platform will rotate freely about a generally vertical axis A (FIG. 3).

Referring to FIG. 7, an underside 68 of the platform 14 includes a groove 70 which is sized to correspond to the groove 56 formed in the base 12. The groove 70 is also sized to receive the ball bearings 64 of the bearing assembly 62 such that the ball bearings 64 engage both groves 56 and 70, thus allowing free rotation of the platform 14 relative to the base 12.

Figure 8:
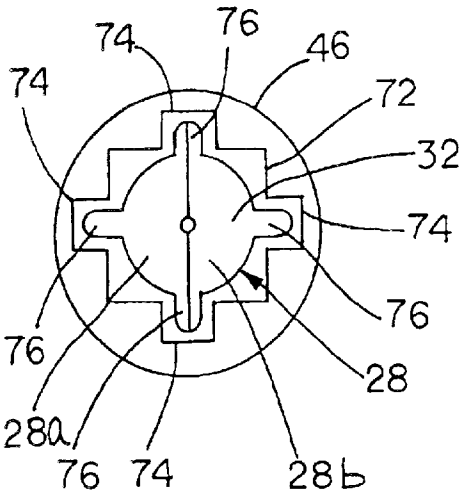
FIG. 8 is an enlarged fragmentary view of the connection between the lower end of the post and the base.

Referring now to FIG. 8, a receiving aperture 72 of the center section 46 of the base 12 is shown in greater detail. Preferably, the receiving aperture 72 is sized and shaped to receive the lower end 32 of the post 28. In the disclosed example, the receiving aperture 72 includes a plurality of grooves 74. The grooves 74 are sized to receive corresponding protrusions 76 formed on the lower section 32 of the post 28, such that the post 28 remains non-rotational with respect to the base 12. Alternatively, other suitable shapes for the lower section 32 and the receiving aperture 72 may be chosen. The post 28 may be suitably secured to the base 12 using a screw 78 from below (FIG. 3).

Figure 9:
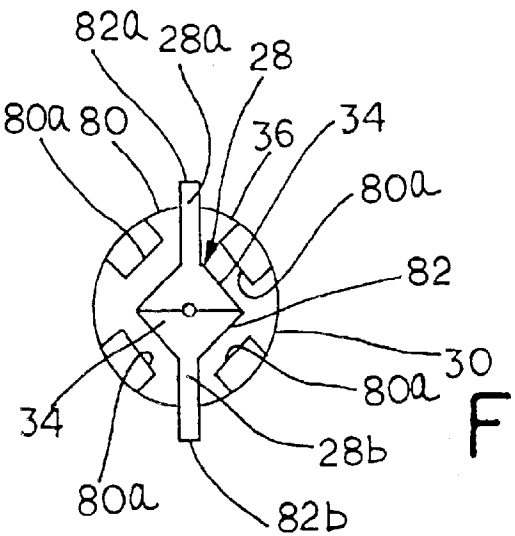
FIG. 9 is an enlarged fragmentary view of the upper end of the post and the hand grip.

Referring now to FIG. 9, a receiving aperture 80 formed on the underside of the hand grip 30 is shown in greater detail. Preferably, the receiving aperture 80 is sized and shaped to receive the upper end 34 of the post 28. In the disclosed example, the receiving aperture 80 includes a plurality of faces 80*a*, which faces 80*a* are sized and shaped to receive a corresponding rectangular section 82 formed by the cooperating halves 28*a* and 28*b* of the upper section 34 of the post 28. The halves 28*a* and 28*b* may further include protrusions 82*a* and 82*b* which extend through the spaces between the faces 80*a*. Thus, the hand grip 30 remains non-rotational with respect to the post 28 as well as the base 12. Alternatively, other suitable shapes for the upper section 34 of the post 28 and the receiving aperture 80 may be chosen. The hand grip 30 may be suitably secured to the post 28 using a screw 84 from above (FIG. 3).

The base 12, the platform 14, the post 28, and the hand grip 30 be formed from high impact plastic or other suitable materials of the type commonly employed in the art. Such components may be injection molded, blow molded, or formed using other suitable forming techniques of the type commonly employed in the art.

In operation, after placement of the ball bearings 64 and the spacers 66 in the groove of the raised ring 48, the platform 14 is placed on the base 12 such that the groove 70 in the underside 68 of the platform 14 sits atop the groove 56 of the base 12 and in contact with the ball bearings 66. The platform 14 is then secured to the base 12 using the ring 47 and the attachment screw 47*c* as discussed above. After bringing the two halves 28*a* and 28*b* together, the post 28 is then secured to the base 12 using the screw 78 from below. Finally, the hand grip 30 is secured to the upper section 34 of the post using the screw 84 from above.

The sitting toy 10 may then be connected to the water source 27 using the connector 26 and the hose 27*a*. Upon activating the water source 27, pressurized water enters the conduit 22 and exits the conduit 22 via the nozzles 24. Preferably, the nozzles 24 are directed generally upwardly, thus generally surrounding the platform 14 with a cascade of water jets, thereby enhancing the pay value of the sitting toy 10.

Numerous additional modifications and alternative embodiments of the invention will be apparent to those skilled in the art in view of the foregoing description. This description is to be construed as illustrative only, and is for the purpose of teaching those skilled in the art the best mode of carrying out the .invention. The details of the structure and method may be varied substantially without departing from the spirit of the invention, and the exclusive use of all modifications which come within the scope of the appended claims is reserved.

What is claimed is:

1. A sitting toy, comprising:

a base;

a platform rotatably mounted to the base and including an outer periphery;

a handle engaging the base; and a conduit generally surrounding a major portion of the base, the conduit arranged for attachment to a water supply, the conduit including a plurality of nozzles disposed adjacent the outer periphery of the platform.

2. The sitting toy of claim 1, wherein the platform includes a central aperture, and wherein the handle protrudes upwardly from the base through the central aperture.

3. The sitting toy of claim 1, wherein the nozzles are pointed generally upwardly.

4. The sitting toy of claim 1, wherein the base includes a rim adapted to rotatably support the platform, and wherein the conduit is spaced radially outwardly from the rim.

5. The sitting toy of claim 4, wherein the platform includes a downwardly extending skirt, the base including a channel defined radially inwardly from the conduit, the channel sized to receive a lower portion of the skirt.

6. The sitting toy of claim 4, wherein the platform includes an outer periphery and the base includes a channel defined radially inwardly from the conduit, the channel sized to receive a portion of the outer periphery of the skirt.

7. The sitting toy of claim 1, wherein the conduit includes an inlet sized for connection to a garden hose.

8. A sitting toy, comprising:

a base;

a platform mounted to the base for rotation about a generally vertical axis, the platform including an outer periphery, the platform including a central aperture;

a handle mounted to the base and extending upwardly through the aperture in the platform; and a conduit formed in the base, the conduit including a plurality of nozzles spaced at intervals about the outer periphery of the platform, the conduit arranged for attachment to a water supply.

9. The sitting toy of claim 8, wherein the conduit is formed in an outer circumferential portion of the base.

10. The sitting toy of claim 8, wherein the nozzles are pointed generally upwardly.

11. The sitting toy of claim 8, wherein the base includes a ring adapted to rotatably support the platform, and wherein the conduit is spaced radially outwardly from the rim.

12. The sitting toy of claim 11, wherein the platform includes a downwardly extending skirt, the base including a channel defined radially inwardly from the conduit, the channel sized to receive a lower portion of the skirt.

13. The sitting toy of claim 11, wherein the base includes a channel defined radially inwardly from the conduit, the channel sized to receive a portion of the outer periphery of the skirt.

14. The sitting toy of claim 8, wherein the conduit includes an inlet sized for connection to a garden hose.

15. The sitting toy of claim 8, wherein the outer periphery of the platform forms a skirt, the base including a channel spaced radially inwardly from the nozzles and sized to receive the skirt, and wherein the skirt and the channel define a clearance gap.

16. A sitting toy, comprising:

a base;

a round platform mounted to the base for rotation about a generally vertical axis, the platform including a central aperture;

a handle mounted to the base and extending upwardly through the aperture in the platform; and a conduit formed in the base and including a plurality of nozzles, the conduit arranged for attachment to a water supply, the nozzles spaced around the base to generally surround the handle and the central axis.

17. The sitting toy of claim 18, wherein the conduit is formed in an outer circumferential portion of the base and wherein the nozzles generally surround an outer periphery of the platform.

18. The sitting toy of claim 16, wherein the nozzles are pointed generally upwardly.

19. The sitting toy of claim 16, wherein the base includes a ring adapted to rotatably support the platform, and wherein at least a portion of the conduit is spaced radially away from the rim.

20. The sitting toy of claim 16, wherein the platform includes a circumferential skirt and the base includes a channel spaced radially from the nozzles and sized to receive the skirt, and wherein the skirt and the channel define a clearance gap.

* * * * *

UNITED STATES PATENT AND TRADEMARK OFFICE

CERTIFICATE OF CORRECTION

PATENT NO. : 6,808,457 B1
APPLICATION NO. : 10/424512
DATED : October 26, 2004
INVENTOR(S) : William M. Paukert et al.

It is certified that error appears in the above-identified patent and that said Letters Patent is hereby corrected as shown below:

In the Specification: Title Page (74): Delete "Marshall Gerstein & Borun LLP" and insert instead -- Marshall, Gerstein & Borun LLP --.

In the Claims:

Col. 6, line 30: Delete "18" and insert instead -- 16 --.

Signed and Sealed this

Third Day of April, 2007

JON W. DUDAS
*Director of the United States Patent and Trademark Office*